US008568661B2

(12) United States Patent
Werni et al.

(10) Patent No.: US 8,568,661 B2
(45) Date of Patent: Oct. 29, 2013

(54) EXHAUST GAS TREATMENT DEVICE

(75) Inventors: Marcus Werni, Waiblingen (DE); Michael Bay, Unna (DE); Wolfgang Datz, Tübingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 248 days.

(21) Appl. No.: 12/796,799

(22) Filed: Jun. 9, 2010

(65) Prior Publication Data

US 2011/0023471 A1 Feb. 3, 2011

(30) Foreign Application Priority Data

Jun. 10, 2009 (DE) ..... 10 2009 024 534

(51) Int. Cl.
*B01D 50/00* (2006.01)

(52) U.S. Cl.
USPC ..... 422/180; 422/177

(58) Field of Classification Search
USPC ..... 422/177, 180; 285/340, 344, 364
See application file for complete search history.

(56) References Cited

U.S. PATENT DOCUMENTS

| | | | | |
|---|---|---|---|---|
| 5,403,557 | A * | 4/1995 | Harris | 422/169 |
| 6,632,406 | B1 | 10/2003 | Michelin et al. | |
| 7,451,594 | B2 * | 11/2008 | Blaisdell | 60/324 |
| 2003/0097834 | A1 | 5/2003 | Gabe et al. | |
| 2006/0010861 | A1 | 1/2006 | Heydens | |
| 2007/0148058 | A1 * | 6/2007 | Buckel et al. | 422/180 |
| 2008/0060351 | A1 * | 3/2008 | Pawson et al. | 60/299 |
| 2009/0158720 | A1 | 6/2009 | Krause et al. | |

FOREIGN PATENT DOCUMENTS

| | | | |
|---|---|---|---|
| DE | 199 59 955 | A1 | 6/2000 |
| EP | 1 312 776 | A2 | 5/2003 |
| EP | 2 075 426 | A1 | 7/2009 |

* cited by examiner

*Primary Examiner* — Tom Duong
(74) *Attorney, Agent, or Firm* — McGlew and Tuttle, P.C.

(57) ABSTRACT

An exhaust gas treatment device (1) for an exhaust system of an internal combustion engine, especially of a motor vehicle, has a multipart housing (2), which contains an oxidation-type catalytic converter unit (5) and, downstream therefrom, a particle filter unit (6) one after another in an axial direction extending in parallel to a longitudinal direction (3) of the housing. The housing (2) contains an inlet housing part (7), which has an exhaust gas inlet (8) and the oxidation-type catalytic converter unit (5), and an outlet housing part (9), which has an exhaust gas outlet (10) and into which the particle filter unit (6) axially protrudes. The maintenance of the exhaust gas treatment device is simplified if at least two housing parts (7, 9, 12) axially adjoining each other are detachably connected to one another by means of a clamp connection (11) and if at least one bracket (13) is provided, which is axially rigid in relation to the particle filter unit (6) and which cooperates with at least one such clamp connection (11), such that the bracket (13) is axially fixed at least one housing part (7, 9, 12) by means of the respective clamp connection (11).

20 Claims, 4 Drawing Sheets

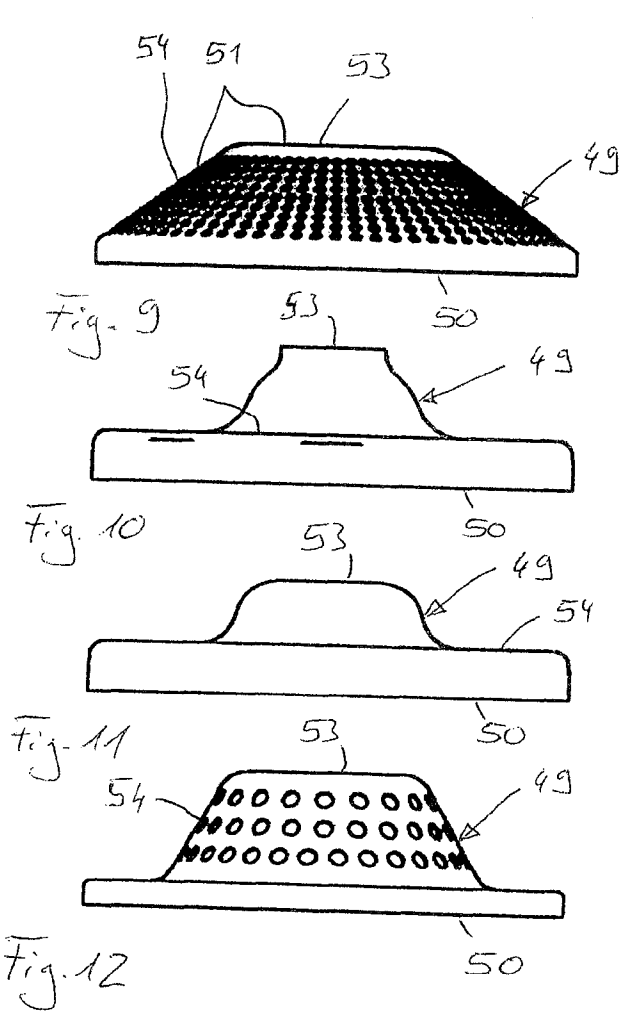
49
50
53
51
54
Fig. 9
Fig. 10
Fig. 11
Fig. 12
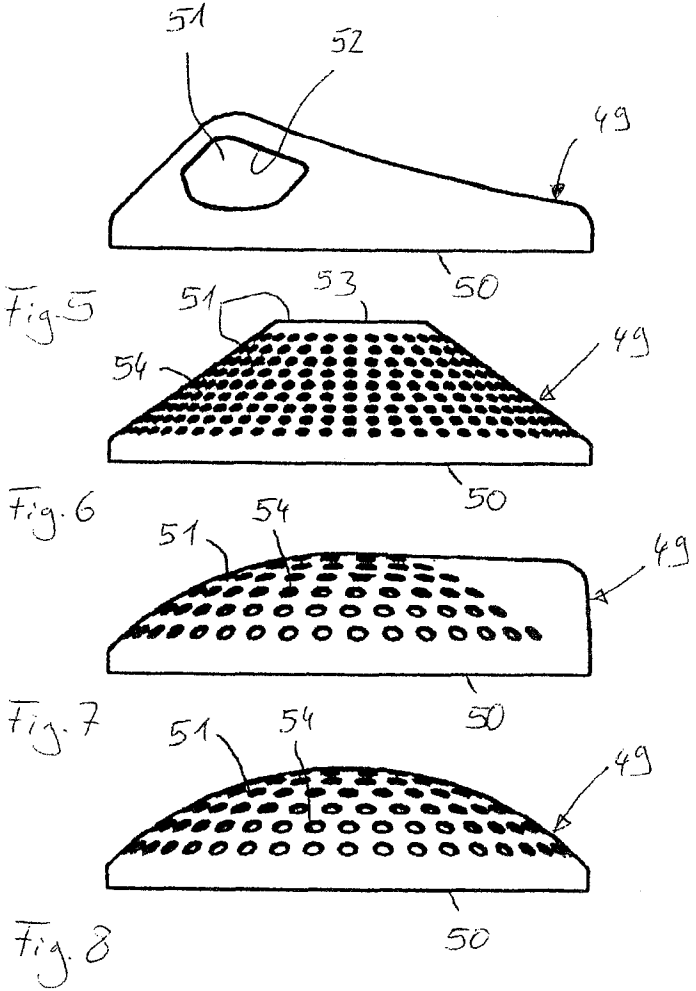
49
50
52
53
51
54
Fig. 5
Fig. 6
Fig. 7
Fig. 8

EXHAUST GAS TREATMENT DEVICE

CROSS REFERENCE TO RELATED APPLICATIONS

This application claims the benefit of priority under 35 U.S.C. §119 of German patent application DE 10 2009 024 534.0 filed Jun. 10, 2009 the entire contents of which are incorporated herein by reference.

FIELD OF THE INVENTION

The present invention pertains to an exhaust gas treatment device for an exhaust system of an internal combustion engine, especially of a motor vehicle.

BACKGROUND OF THE INVENTION

Exhaust gas treatment device are, for example, catalytic converters and particle filters as well as combinations thereof. For example, an oxidation-type catalytic converter unit as well as a particle filter unit may be arranged one after another in a common housing to achieve a compact design. Hydrocarbons being carried in the exhaust gas can be reacted by means of the oxidation-type catalytic converter. The particle filter removes particles being carried in the exhaust gas, especially soot. Fuel, which is reacted at the catalytic converter exothermally, may be dispensed upstream of the oxidation-type catalytic converter to regenerate the particle filter. As a result, the particle filter arranged downstream in relation thereto can be heated to an ignition temperature, at which the soot particles deposited in the filter burn off in order to thus bring about the regeneration of the particle filter.

The oxidation-type catalytic converter unit may become worn more or less in the course of the operation of the exhaust gas treatment device. Furthermore, residues that cannot be burned off may remain in the particle filter unit, and these residues increasingly collect over time and gradually clog the particle filter in question. It may be correspondingly necessary to maintain the unit in question and to replace it with a new one if necessary. A comparatively great effort is needed to remove the oxidation-type catalytic converter unit and/or the particle filter unit from the common housing.

SUMMARY OF THE INVENTION

The object of the present invention is to propose an improved embodiment for an exhaust gas treatment device of the type mentioned in the introduction, which is characterized in that the accessibility to the respective unit for maintenance purposes and the like is simplified.

The present invention is based on the general idea of axially rigidly arranging a bracket at the particle filter unit and of axially fixing said bracket to the housing by means of a clamp connection, which detachably connects at least two housing parts adjoining each other axially with one another. The clamp connection, which is present anyway, assumes an additional function hereby, because it fixes the two adjacent housing parts to one another, on the one hand, and because it fixes the bracket to the housing, on the other hand. By releasing the clamp connection, the housing parts are mobile in relation to one another, on the one hand, whereas the bracket is also mobile relative to the housing, on the other hand. In particular, the particle filter unit can then be removed from the housing in an especially simple manner.

Corresponding to an advantageous embodiment, a middle housing part may be provided, which is arranged axially between an inlet housing part and an outlet housing part. At least one axial section of the particle filter unit is arranged in this middle housing part. Furthermore, it is connected to the inlet housing part via an inlet-side clamp connection and to the outlet housing part via an outlet-side clamp connection. Simplified accessibility is obtained to the interior of the housing by removing the middle housing part.

In a variant, the middle housing part may be arranged axially rigidly at the particle filter unit. The above-mentioned, at least one bracket may be formed on the middle housing part or may be formed by this, and at least one of the clamp connections detachably connects the middle housing part with the respective adjacent housing part via the corresponding bracket. This means that the respective bracket forms a flange at the middle housing part, which is connected to a corresponding flange of the respective adjacent housing part via the respective clamp connection. Since the respective bracket forms part of the middle housing part, axial fixation of the bracket and hence of the particle filter unit to the housing is achieved due to the fastening of the middle housing part to the adjacent housing parts.

In another embodiment, which makes do without such a middle housing part, the clamp connection connects the inlet housing part with an outlet housing part. The bracket coupled with the particle filter unit now cooperates with this one clamp connection such that the bracket is fixed axially to both housing parts. The bracket is integrated due to this design in the clamp connection, so that the desired axial fixation of the particle filter unit in the housing takes place automatically due to the connection of the two housing parts. For example, the bracket may have two flanges for this, which cooperates with flanges of the two housing parts, which said flanges are complementary thereto, in order to establish the clamp connection.

Further important features and advantages of the present invention appear from the subclaims, from the drawings and from the corresponding description of the figures on the basis of the drawings.

It is obvious that the above-mentioned features, which will also be explained below, can be used not only in the particular combination indicated, but in other combinations or alone as well, without going beyond the scope of the present invention.

Preferred exemplary embodiments of the present invention are shown in the drawings and will be explained in more detail in the following description, wherein identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is a side view of inflow an funnel of one of different embodiments;

FIG. 6 is a side view of inflow an funnel of another of different embodiments;

FIG. 7 is a side view of inflow an funnel of another of different embodiments;

FIG. 8 is a side view of inflow an funnel of another of different embodiments;

FIG. 9 is a side view of inflow an funnel of another of different embodiments;

FIG. 10 is a side view of inflow an funnel of another of different embodiments;

FIG. 11 is a side view of inflow an funnel of another of different embodiments;

FIG. 12 is a side view of inflow an funnel of still another of different embodiments.

DESCRIPTION OF THE PREFERRED EMBODIMENTS

Figure 1:
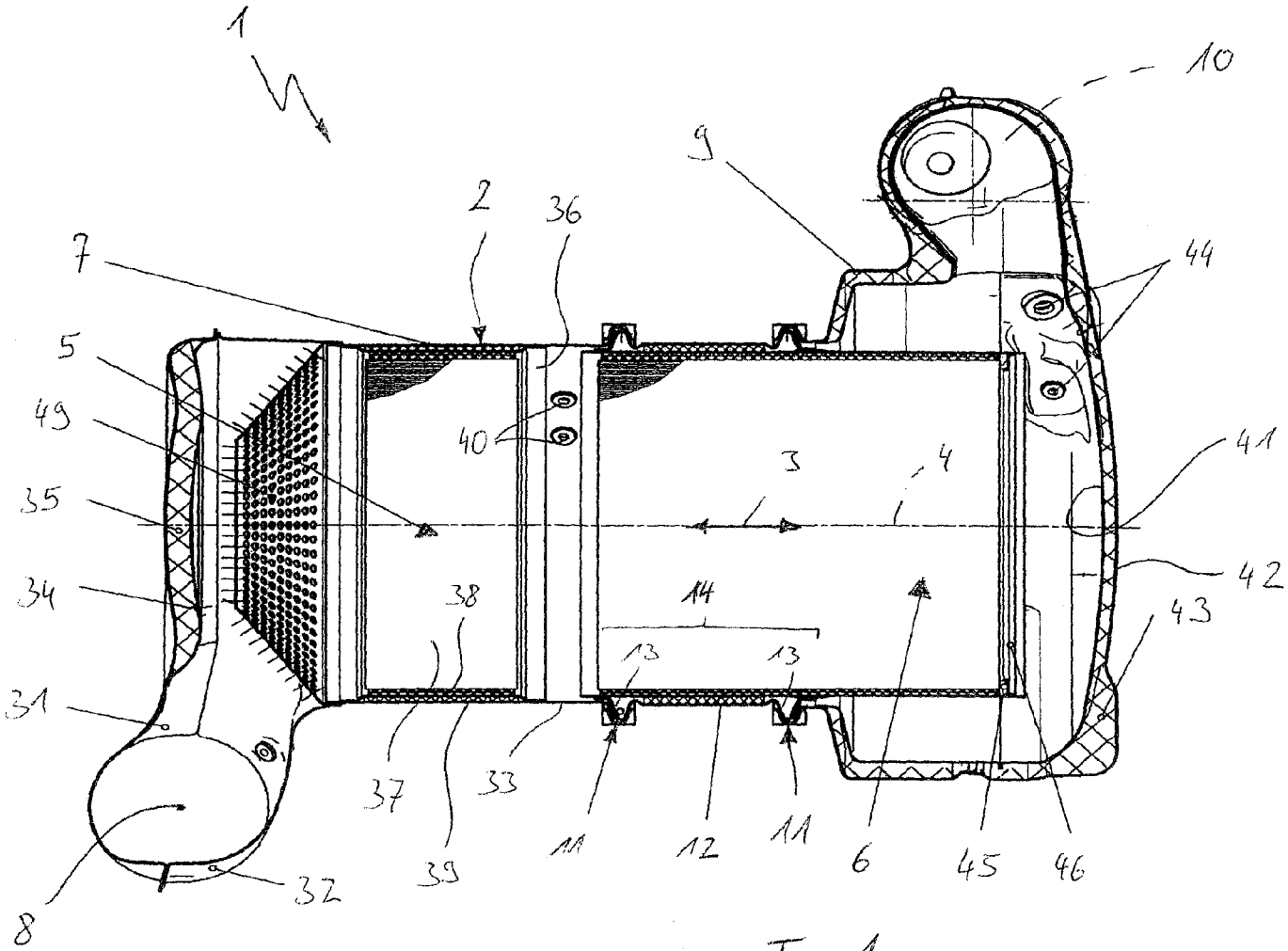
FIG. 1 is a simplified longitudinal sectional view through an exhaust gas treatment device.

Referring to the drawings in particular, corresponding to FIG. 1, an exhaust gas treatment device 1 is provided, which can be used in an exhaust system of an internal combustion engine. The internal combustion engine is preferably located in a motor vehicle. The exhaust gas treatment device 1 comprises a multipart housing 2, which extends in a longitudinal direction 3. The longitudinal direction 3 of the housing extends here parallel to a central longitudinal axis 4 of housing 2 and defines an axial direction, which will hereinafter be likewise designated by 3. In respect to this axial direction 3, housing 2 contains an oxidation-type catalytic converter unit 5 and a particle filter unit 6 arranged downstream thereof one behind the other.

Housing 2 has an inlet housing part 7, which is equipped with an exhaust gas inlet 8 and in which the oxidation-type catalytic converter 5 is arranged. Furthermore, housing 2 has an outlet housing part 9, which has an exhaust gas outlet 10 and into which the particle filter unit 6 protrudes. To obtain an especially compact design, the exhaust gas inlet 8 may be oriented at right angles to the axial direction 3. In addition or as an alternative, the exhaust gas outlet 10 may also be oriented at right angles to the axial direction 3.

In addition, the exhaust gas treatment device 1 is equipped with at least one clamp connection 11, by means of which two housing parts, which axially adjoin one another, are detachably connected to one another. The embodiment shown in FIGS. 1 and 2 has two such clamp connections 11, namely, an inlet-side or first clamp connection 11*a* and an outlet-side or second clamp connection 11*b*. The inlet-side clamp connection 11*a* connects the inlet housing part 7 with a middle housing part 12, which is arranged axially between the inlet housing part 7 and the outlet housing part 9. The outlet-side clamp connection 11*b* connects the outlet housing part 9 with the middle housing part 12. Contrary to this, FIGS. 3 and 4 show another embodiment, in which the exhaust gas treatment device 1 has only a single clamp connection 11 to connect the inlet housing part 7 with the outlet housing part 9.

Figure 2:
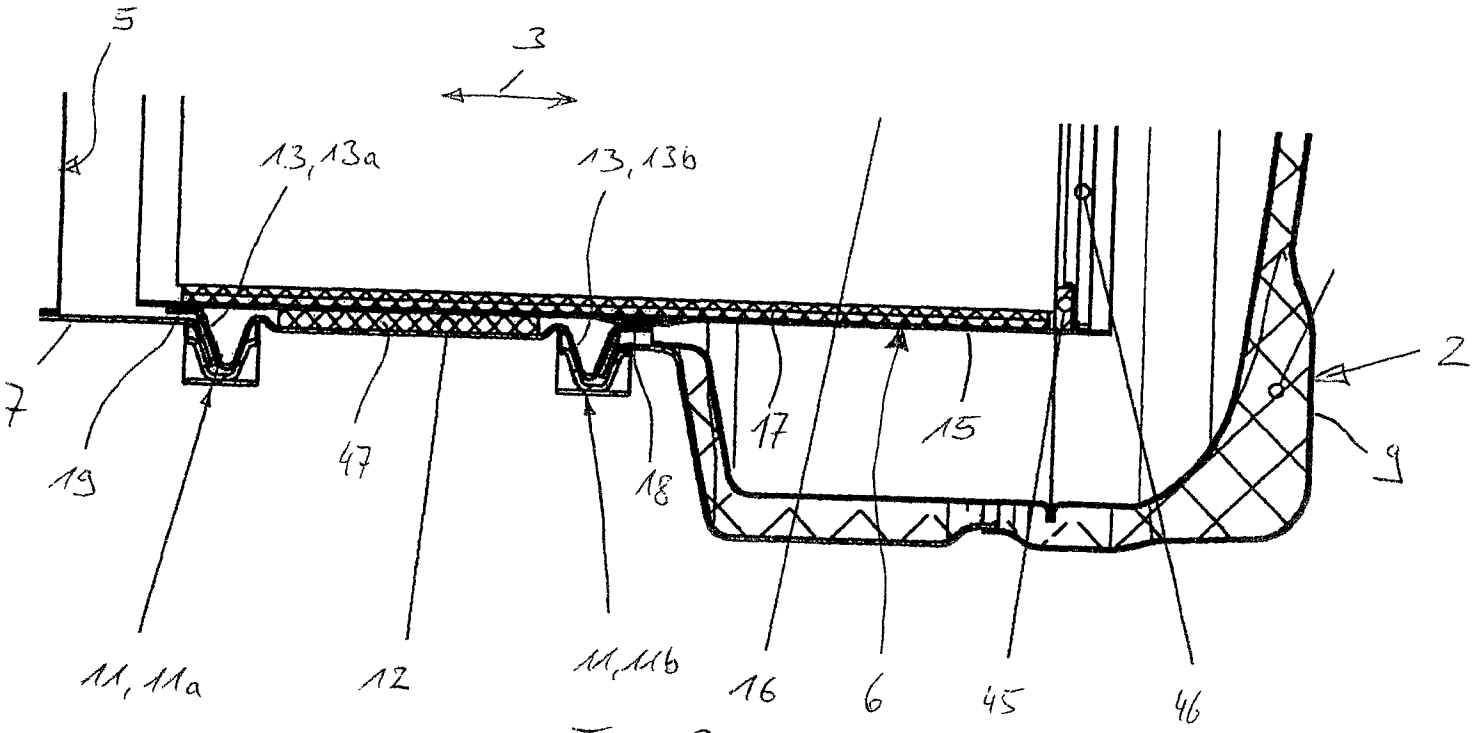
FIG. 2 is an enlarged sectional view in the area of a particle filter unit.
Figure 3:
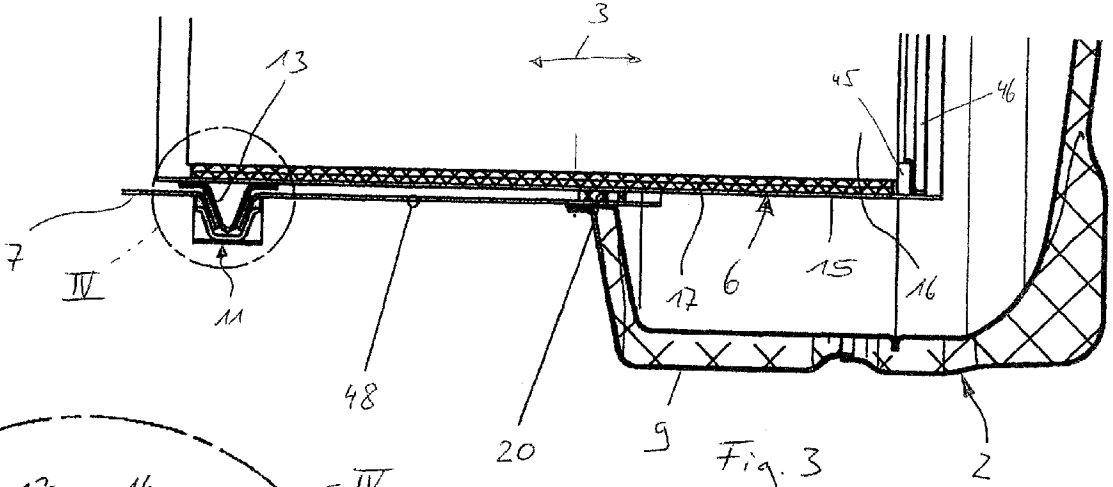
FIG. 3 is an enlarged sectional view in the area of a particle filter unit for another embodiment.
Figure 4:
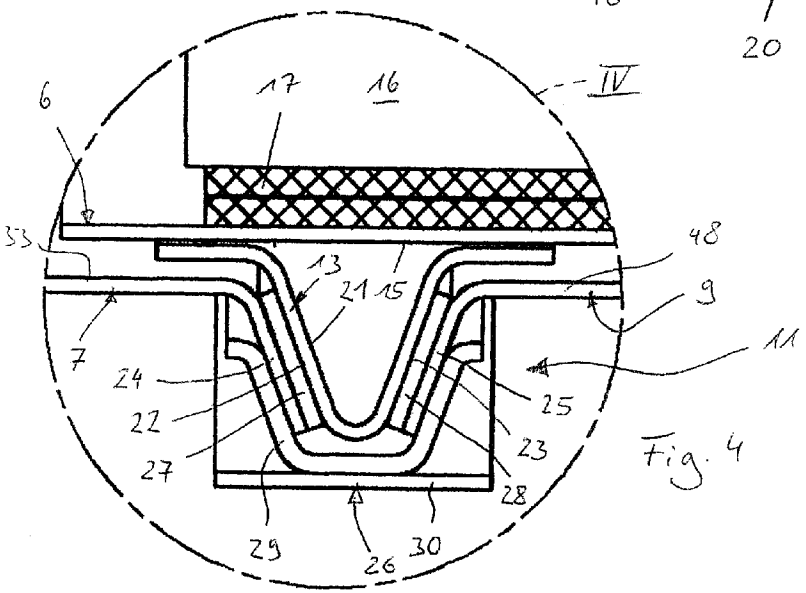
FIG. 4 is an enlarged detail IV from FIG. 3.

Corresponding to FIGS. 1 through 4, at least one bracket 13 is provided, moreover, which is arranged axially rigidly in relation to the particle filter unit 6. Two such brackets 13 are provided in the embodiment shown in FIGS. 1 and 2, namely, an inlet-side bracket 13*a* and an outlet-side bracket 13*b*. Contrary to this, the embodiment shown in FIGS. 3 and 4 shows only a single bracket 13.

The respective bracket 13 cooperates with at least one clamp connection 11, doing so such that the respective clamp connection 11 axially fixes the respective bracket 13 at the housing 2 or at least one housing part 7, 9, 12. Due to the axial fixation of the respective bracket 13 at housing 2, the particle filter unit 6, which is axially rigidly coupled with the respective bracket 13, is automatically fixed axially in the housing 2 as well. At the same time, this means that when the clamp connection 11 is released, fixation of the respective bracket 13 is abolished, as a result of which the fixation of the position of the particle filter unit 6 is abolished as well. As a consequence, the particle filter unit 6 can be removed from the outlet housing part 9 when housing 2 is opened.

In the embodiment shown in FIGS. 1 and 2, the middle housing part 12 is detachably connected to the inlet housing part 7 via the inlet-side clamp connection 11*a* and to the outlet housing part 9 via the outlet-side clamp connection 11*b*. Furthermore, the particle filter unit 6 also extends within the middle housing part 12. As a consequence, an axial section 14 of the particle filter unit 6, which is designated by braces in FIG. 1, is arranged in the middle housing part 12. The middle housing part 12 is arranged rigidly at the particle filter unit 6 at least in the axial direction 3 in this embodiment. For example, the particle filter unit 6 comprises a particle filter tube 15, in which at least one particle filter element 16 is positioned by means of a mounting mat 17. The middle housing part 12 may be rigidly connected to this particle filter tube 15, for example, by means of a soldered connection or by means of a welded connection. The middle housing part 12 is of a tubular design in the example and is axially rigidly connected to the particle filter tube 15 at an axial end area 18 facing the outlet housing part 9, whereas it is arranged axially displaceably at the particle filter tube 15 at an axial end area 19 facing the inlet housing part 7. The end area 18 arranged axially rigidly at the particle filter tube 15 is located approximately in the middle of the particle filter unit 6, whereas the displaceable end area 19 is arranged on the end side at the particle filter unit 6. The displaceable end section 19 forms a sliding fit and makes possible relative motions caused by thermal effects between the middle housing part 12 and the particle filter tube 15. The two brackets 13*a*, 13*b* are formed directly at the middle housing part 12. Brackets 13*a*, 13*b* are preferably formed integrally at the middle housing part 12. The inlet-side bracket 13*a* forms an inlet-side flange of the middle housing part 12, which can be connected in conjunction with the inlet-side clamp connection 11*a* to a corresponding flange of the inlet housing part 7. Analogously hereto, the outlet-side bracket 13*b* forms an outlet-side flange of the middle housing part 12, which can be connected to a corresponding flange of the outlet housing part 9 via the outlet-side clamp connection 11*b*.

Bracket 13 is integrated in the clamp connection 11 in the embodiment shown in FIGS. 3 and 4 such that bracket 13 is also fixed axially at housing 2 or the two housing parts 7, 9 thereof due to the axial connection of the two housing parts 7, 9. Bracket 13 is fastened to the particle filter tube 15 in this embodiment, for example, by means of a soldered connection or clamp connection. Bracket 13 is arranged for this purpose in an end area of the particle filter unit 6, which said end area faces the inlet housing part 7. The particle filter unit 6 or its particle filter tube 15 is axially supported via a wire mesh ring 20 at the outlet housing part 9. The wire mesh ring 20 makes possible an axial displaceability between the outlet housing part 9 and the particle filter tube 15. The wire mesh ring 20 is at a comparatively great distance from bracket 13. For example, the distance measured in the axial direction 3 between the individual bracket 13 and the wire mesh ring 20 is at least 50% of a length of the particle filter unit 6, which is likewise measured in the axial direction 3. As a result, stable support and fixation of the position of the particle filter unit 6 in housing 2 is achieved.

In the embodiments being shown here, the respective bracket 13 has a V-section 21 in the axial section. This V-section 21 has an inlet-side flank 22 as well as an outlet-side flank 23. The inlet housing part 7 has a ring collar 24, which fits the inlet-side flank 22 and forms a connecting flange of the inlet housing part 7. The outlet housing part 9 correspondingly has a ring collar 25, which fits the outlet-side flange 23 and forms a connecting flange of the outlet housing part 9. Furthermore, the respective clamp connection 11 has a clamp 26, which prestresses the respective ring collar 24 or 25 axially against the respective flank 22 and 23. An inlet-side sealing element 27 may be optionally arranged between the ring collar 24 of the inlet housing part 7 and the inlet-side flank 22. An outlet-side sealing element 28 may likewise be arranged between the ring collar 25 of the outlet housing part 9 and the outlet-side flank 23 of the outlet-side sealing element 28.

Clamp 26 is equipped with a V-section 29 here, whose flanks, not designated more specifically, extend over and axially prestress the respective ring collars 24, 25 as well as the respective bracket 13. Clamp 26 can therefore also be called a V-clamp. Clamp 26 has, besides a tightening strap in the example, which extends circumferentially in the circumferential direction and cooperates with a tightening means, not shown here, in order to make it possible to introduce a tensile stress oriented in the circumferential direction into clamp 26. Clamp 26 can therefore also be called a band clamp and especially also a V-band clamp.

In the embodiment shown in FIGS. 3 and 4, clamp 26 axially prestresses, on the one hand, the inlet-side ring collar 24 axially against the inlet-side flank 22 of bracket 13, and, on the other hand, the outlet-side ring collar 25 axially against the outlet-side flank 23 of bracket 13. Bracket 13 forms a support located on the inside for the two ring collars 24, 25.

In the embodiment shown in FIGS. 1 and 2 clamp 26 axially prestresses the inlet-side clamp connection 23*a*, on the one hand, axially against the inlet-side flank 22 of the inlet-side bracket 13*a* and, on the other hand, it supports same at the outlet-side flank 23 of the inlet-side bracket 13*a*. Furthermore, clamp 26 of the outlet-side clamp connection 11*b* axially prestresses, on the one hand, the outlet-side ring collar 25 against the outlet-side flank 23 of the outlet-side bracket 13*b*, while, on the other hand, it is supported at the inlet-side flank 22 of the outlet-side bracket 13*b*.

In the example shown in FIGS. 3 and 4 the inlet-side ring collar 24 is supported via the inlet-side sealing element 27 at the inlet-side flank 22, whereas the outlet-side ring collar 25 is supported at the same bracket 13 at the outlet-side flank 23 via the outlet-side sealing element 28. Contrary to this, the inlet-side ring collar 24 is supported in the embodiment shown in FIGS. 1 and 2 at the inlet-side clamp connection 11*a* at the inlet-side flank 22 of the inlet-side bracket 13*a* via the inlet-side sealing element 27, while the inlet-side clamp 26 is directly in contact with the outlet-side flank 23 of the inlet-side bracket 13*a*, i.e., without an additional sealing element. Another sealing element, which is arranged between clamp 26 and bracket 13, may be provided, in principle, here as well. This also applies to the outlet-side clamp connection 11*b*. The outlet-side ring collar 25 is brought into contact there with the outlet-side flank 23 of the outlet-side bracket 13*b* via the outlet-side sealing element 28, while the respective flank of the outlet-side clamp 26 comes here directly into contact with the inlet-side flank 22 of the outlet-side bracket 13*b*. An additional sealing element may be optionally provided here as well.

Corresponding to FIGS. 1 through 4, the inlet housing part 7 may be assembled from an upper shell 31, a lower shell 32 and a tubular body 33. An inner bottom 34 inserted into the upper shell 31 leads to a double-walled design at the inlet-side, axial end area of housing 2. This double-walled design provides a hollow space, which makes air gap insulation possible or may be filled, as here, with a heat-insulating insulating material.

The oxidation-type catalytic converter unit 5 comprises a catalytic converter tube 36, in which at least one catalytic converter element 37 is positioned by means of a mounting mat 38. The catalytic converter tube 36 may be supported axially at the front and axially in the rear at the tubular body 33 of the inlet housing part 7 and define an annular space 39 with the tubular body 33 between its axial ends. This annular space 29 may likewise form an air gap insulation. Furthermore, it may also be filled with an insulating material. Connection sites 40 for probes may be provided in the area of inlet housing part 7.

The outlet housing part 9 may have, corresponding to the embodiments being shown here, an inner shell 41 and an outer shell 42, between which a distance is maintained, which makes possible an air gap insulation and which may be filled with an insulating material. Furthermore, ports 44 for probes and the like may also be provided at the outlet housing part 9.

The particle filter unit 6 is equipped in the example being shown with an axial pad 45 as well as with a wire mesh ring 46 in order to axially support the particle filter element 16 on the discharge flow side at the particle filter tube 15.

In addition, a mounting mat 47, via which the middle housing part 12 is supported at the particle filter unit 6 or at the particle filter tube 15 thereof, is provided in the embodiment shown in FIGS. 1 and 2. The outlet housing part 9 has, besides, a tubular body 48, which is connected to the inner shell 41 and/or outer shell 42 and which has the outlet-side ring collar 25 of the outlet housing part 9 in the embodiment shown in FIGS. 3 and 4.

Corresponding to FIG. 1, an inflow funnel 49 is arranged in the inlet housing part 7 corresponding to the preferred embodiment being shown here, namely, upstream of the oxidation-type catalytic converter unit 5. The inflow funnel 49 is designed such that it expands in the direction of flow. Corresponding to FIGS. 5 through 12, this inlet funnel 49 may have various designs. In all embodiments, it has a discharge side 50, whose cross section corresponds essentially to the inlet cross section of the oxidation-type catalytic converter unit 5. Contrary to this, an inlet side 51 at the respective inlet funnel 49 may have various designs.

The inlet side 51 is formed by a single inlet opening 52 in the embodiment shown in FIG. 5.

In the embodiment shown in FIG. 6, the inlet side 51 comprises a central inlet opening 53 located opposite the outlet side 50 as well as a perforation 54, which is formed at the shell body of the inflow funnel 49.

Corresponding to FIGS. 7 and 8, the central inlet opening 53 may also be done away with, so that the inlet side 51 is formed by the perforation 54 only in these embodiments.

FIG. 9 shows an embodiment in which a central inlet opening 53 is again combined with a perforation 54 in order to form the inlet side 51. Perforation 54 has a markedly smaller hole width here than, e.g., in the embodiments according to FIGS. 6 through 8. The flow resistance of perforation 54 can be determined by the hole width thereof. The hole width affects the homogenizing action of the inflow funnel 49.

An inlet opening 53 may be provided in the embodiments according to FIGS. 10, 11 and 12. In addition or as an alternative, a perforation 54 may be provided as well, which may be present at a disk-shaped section of the inlet funnel 49 in the embodiments according to FIGS. 10 and 11 or may again be formed at the jacket-like section corresponding to the embodiment shown in FIG. 12.

The inlet funnel 49 is, on the whole, truncated cone-shaped or has at least one truncated cone-shaped section in the embodiments according to FIGS. 6 and 9 through 12. Contrary to this, the inlet funnel 49 is formed by a segment of a spherical shell in the embodiments according to FIGS. 7 and 8.

Inlet funnel 49 makes possible the homogenization of the flow arriving at the oxidation-type catalytic converter unit 5 with extremely compact installation conditions, even in case of an exhaust gas inlet 8 oriented at right angles to the axial direction 3.

While specific embodiments of the invention have been shown and described in detail to illustrate the application of the principles of the invention, it will be understood that the invention may be embodied otherwise without departing from such principles.

What is claimed is:

1. An exhaust gas treatment device for a motor vehicle exhaust system of an internal combustion engine, the exhaust gas treatment device comprising:

a multipart housing;

an oxidation-type catalytic converter unit disposed in the multipart housing;

a particle filter unit disposed in the multipart housing downstream from said oxidation-type catalytic converter unit, arranged one after another in an axial direction extending in parallel to a longitudinal direction of the housing, wherein the multipart housing has an inlet housing part, which has an exhaust gas inlet and contains the oxidation-type catalytic converter unit, said inlet housing part comprising an inlet-side ring collar, said multipart housing has an outlet housing part, which has an exhaust gas outlet and into which the particle filter unit protrudes axially, said outlet housing part comprising an outlet-side ring collar;

at least one clamp connection, wherein at least said inlet housing part is detachably connected to said outlet housing part by means of the clamp connection, wherein at least said inlet housing part and said outlet housing part are fixed in an axial direction of said multipart housing via said clamp connection; and at least one bracket axially rigid in relation to the particle filter unit, the bracket cooperating with the clamp connection to axially fix the bracket to at least one housing part by means of the clamp connection, at least one of said inlet-side ring collar and said outlet-side ring collar being located between said at least one clamp connection and said at least one bracket.

2. An exhaust gas treatment device in accordance with claim 1, wherein:

the multipart housing further comprises a middle housing part, an axial section of the particle filter unit being arranged in the a middle housing part; and the at least one clamp connection includes an inlet-side clamp connection and an outlet-side clamp connection, the middle housing part being connected to the inlet housing part via the inlet-side clamp connection and the middle housing part being connected to the outlet housing part via the outlet-side clamp connection.

3. An exhaust gas treatment device in accordance with claim 2, wherein:

the middle housing part is arranged axially rigidly at the particle filter unit;

the at least one bracket is formed at the middle housing part; and at least one of the inlet-side clamp connection and the outlet-side clamp connection detachably connects the middle housing part to the respective adjacent housing part via the at least one bracket.

4. An exhaust gas treatment device in accordance with claim 3, wherein:

the at least one bracket includes two brackets formed at the middle housing part;

one of the two brackets is detachably connected to the inlet housing part via the inlet-side clamp connection; and the other of said brackets is detachably connected to the outlet housing part via the outlet-side clamp connection.

5. An exhaust gas treatment device in accordance with claim 2, wherein:

the particle filter unit comprises a particle filter tube containing at least one particle filter element; and the middle housing part is axially rigidly arranged at the particle filter tube at one end and axial displaceably at the other end.

6. An exhaust gas treatment device in accordance with claim 2, wherein:

the bracket has a V-section with an inlet-side flank and with an outlet-side flank;

the inlet-side ring collar fits the inlet flank; and the outlet-side ring collar fitting the outlet-side flank.

7. An exhaust gas treatment device in accordance with claim 6, wherein the respective clamp connection has a clamp, which prestresses the respective ring collar via a sealing element, axially against the respective flank.

8. An exhaust gas treatment device in accordance with claim 7, wherein a clamp of the inlet-side clamp connection axially prestresses the inlet-side ring collar against the inlet-side flank of the inlet-side bracket, on the one hand, and is supported at the outlet-side flank of the inlet-side bracket, on the other hand, wherein a clamp of the outlet-side clamp connection axially prestresses the outlet-side ring collar against the outlet-side flank of the outlet-side bracket, on the one hand, and is supported at the inlet-side flank of the outlet-side bracket, on the other hand.

9. An exhaust gas treatment device in accordance with claim 7, wherein a clamp of the clamp connection axially prestresses the inlet-side ring collar against the inlet-side flank of bracket, on the one hand, and axially prestresses the outlet-side ring collar against the outlet-side flank of bracket, on the other hand.

10. An exhaust gas treatment device in accordance with claim 1, wherein the particle filter unit is arranged at the outlet housing part by means of a wire mesh ring such that the particle filter is radially supported and is axially displaceable.

11. An exhaust gas treatment device in accordance with claim 10, wherein the wire mesh ring is located from the bracket at a distance that equals at least 50% of an axial length of the particle filter unit.

12. An exhaust gas treatment device in accordance with claim 1, further comprising an inflow funnel expanding in a direction of flow, the inflow funnel being arranged in the inlet housing part upstream of the oxidation-type catalytic converter unit.

13. An exhaust gas treatment device in accordance with claim 12, wherein the inflow funnel comprises a perforated jacket.

14. An exhaust gas treatment device in accordance with claim 1, wherein:

the clamp connection detachably connects the inlet housing part to the outlet housing part;

the bracket cooperates with this clamp connection such that the bracket is axially fixed to housing parts;

the particle filter unit is arranged at the outlet housing part by means of a wire mesh ring such that the particle filter is radially supported and is axially displaceable; and the wire mesh ring is located from the bracket at a distance that equals at least 50% of an axial length of the particle filter unit.

15. An exhaust gas treatment device in accordance with claim 1, wherein said particle filter unit comprising an end portion, said outlet housing portion having an inner surface defining an interior space, at least a portion of said end portion being arranged in said interior space, said particle filter unit being fixed in the axial direction via at least said clamp connection.

16. An exhaust gas treatment device for an exhaust system of an internal combustion engine, the exhaust gas treatment device comprising;

a multipart housing with an inlet housing part, which has an exhaust gas inlet and contains the oxidation-type catalytic converter unit and an outlet housing part, which has an exhaust gas outlet and into which the particle filter unit protrudes axially, said outlet housing part defining an outlet housing part space, wherein at least a portion of said particle filter unit is arranged in said outlet housing part space, said inlet housing part comprising an inlet housing portion, said outlet housing part comprising an outlet housing portion;

an oxidation-type catalytic converter unit disposed in the multipart housing;

a particle filter unit disposed in the multipart housing downstream from oxidation-type catalytic converter unit;

a clamp connection detachably connecting at least two adjoining housing parts to one another, wherein said at least two adjoining housing parts are fixed in an axial direction of said multipart housing via said clamp connection; and a bracket axially fixed relative to the particle filter unit, the bracket cooperating with the clamp connection to axially fix the bracket to at least one housing part via the clamp connection, said clamp connection comprising a clamp element, at least one of a portion of said outlet housing portion and at least a portion of said inlet housing portion engaging said clamp element, wherein said at least one of said portion of said outlet housing portion and said at least said portion of said inlet housing portion is arranged between said clamp element and said bracket.

17. An exhaust gas treatment device in accordance with claim 16, wherein:

the multipart housing further comprises a middle housing part, an axial section of the particle filter unit being arranged in the a middle housing part; and the clamp connection comprises an inlet-side clamp connection and an outlet-side clamp connection, the middle housing part being connected to the inlet housing part via the inlet-side clamp connection and the middle housing part being connected to the outlet housing part via the outlet-side clamp connection.

18. An exhaust gas treatment device in accordance with claim 17, wherein:

the middle housing part is arranged axially fixed at the particle filter unit;

the is provided at the middle housing part; and at least one of the inlet-side clamp connection and the outlet-side clamp connection detachably connects the middle housing part to the respective adjacent housing part via the bracket.

19. An exhaust gas treatment device in accordance with claim 18, wherein:

the bracket is part of a bracket arrangement including another bracket provided at the middle housing part;

one of the bracket and the another bracket is detachably connected to the inlet housing part via the inlet-side clamp connection; and the other of the bracket and the another bracket is detachably connected to the outlet housing part via the outlet-side clamp connection.

20. An exhaust gas treatment device in accordance with claim 17, wherein:

the particle filter unit comprises a particle filter tube containing at least one particle filter element; and the middle housing part is axially fixed to the particle filter tube at one end and axial displaceable relative to the particle filter tube at the other end.

* * * * *